US008643451B2

(12) United States Patent
Ham

(10) Patent No.: US 8,643,451 B2
(45) Date of Patent: Feb. 4, 2014

(54) CIRCUIT BREAKER

(75) Inventor: Seung Jin Ham, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/359,444

(22) Filed: Jan. 26, 2012

(65) Prior Publication Data

US 2012/0218062 A1 Aug. 30, 2012

(30) Foreign Application Priority Data

Feb. 25, 2011 (KR) ..... 10-2011-0016865

(51) Int. Cl.

| | |
|---|---|
| ***H01H 75/10*** | (2006.01) |
| ***H01H 77/06*** | (2006.01) |
| ***H01H 81/04*** | (2006.01) |
| ***H01H 9/00*** | (2006.01) |

(52) U.S. Cl.
USPC ..... 335/42; 335/179

(58) Field of Classification Search
USPC ..... 335/179, 42, 237
See application file for complete search history.

(56) References Cited

U.S. PATENT DOCUMENTS

| | | | | | |
|---|---|---|---|---|---|
| 3,157,848 | A | * | 11/1964 | Boiten | 336/110 |
| 3,397,348 | A | * | 8/1968 | Hoeppel | 361/139 |
| 3,522,563 | A | * | 8/1970 | Frydman | 335/153 |
| 3,634,794 | A | * | 1/1972 | Verbeke | 335/153 |
| 3,806,845 | A | | 4/1974 | Zubaty et al. | |
| 3,903,492 | A | * | 9/1975 | Endo et al. | 335/208 |
| 4,253,078 | A | * | 2/1981 | Tagawa et al. | 335/212 |
| 4,713,589 | A | * | 12/1987 | Kashiwagi | 315/400 |
| 6,926,454 | B1 | * | 8/2005 | Naganuma et al. | 396/463 |

FOREIGN PATENT DOCUMENTS

| | | |
|---|---|---|
| KR | 10-2008-0039219 | 5/2008 |
| WO | 79/00105 | 3/1979 |

* cited by examiner

*Primary Examiner* — Alexander Talpalatski
(74) *Attorney, Agent, or Firm* — Lee, Hong, Degerman, Kang & Waimey

(57) ABSTRACT

A circuit breaker is disclosed, wherein the circuit breaker according to an exemplary embodiment of the present disclosure includes a permanent magnet rotatably hinged to a yoke, and wherein the permanent magnet is changed in magnetic path direction thereof by rotation to set up a sensitivity current, whereby a defect ratio of product is minimized.

5 Claims, 8 Drawing Sheets

FIG. 9

| θ | Force[N] |
|---|---|
| 90° | 0.114 |
| 60° | 0.088 |
| 45° | 0.06 |
| 30° | 0.032 |
| 0° | 0.002 |

CIRCUIT BREAKER

Pursuant to 35 U.S.C. §119 (a), this application claims the benefit of earlier filing date and right of priority to Korean Patent Application No. 10-2011-0016865, filed on Feb. 25, 2011, the contents of which is hereby incorporated by reference in their entirety.

BACKGROUND OF THE DISCLOSURE

1. Field

The present disclosure relates to a circuit breaker, and more particularly to a circuit breaker configured to be installed at a wiring.

2. Background

Generally, a circuit breaker is a power device for detecting an abnormal current to automatically break the circuit, thereby protecting life, an electrical load device, and a circuit from an accident current in a power supply circuit between the power source and the load, when the abnormal current such as an over current, an electric shortage current, or the like is generated in the circuit. The circuit breaker is compulsorily installed on a wiring at a house and a factory, for example.

The circuit breaker may be categorized into two types based on operation method, that is, an electronic circuit breaker that operates using a leakage detecting chip, and a circuit breaker in which a trip coil is directly connected to a secondary winding of a ZCT (Zero-phase Current Transformer), where the latter is largely used.

FIG. 1 is a lateral view illustrating a trip coil assembly of a circuit breaker according to prior art, and FIG. 2 is a perspective view illustrating a trip coil assembly of a circuit breaker according to prior art.

The trip coil assembly according to the conventional circuit breaker includes a permanent magnet (10), a yoke (20) forming a magnetic path of a magnetic field induced by the permanent magnet (10), a bracket (30) mounted on the yoke (20) to fix the yoke (20) to the permanent magnet (10), a lever (40) contacted to one side of the yoke (20) to release a connection with a mechanism of the circuit breaker, a trip coil (50) directly connected to a secondary winding of a ZCT, and a spring (60) mounted on the bracket (30) and connected to the lever (40) to provide elasticity to the lever (40).

Now, operation of the conventional circuit breaker will be described.

A current in proportion to a leakage current flows in the trip coil (50) connected to the secondary winding of the ZCT when a leakage occurs, a magnetic field formed by the permanent magnet (10) is offset by an AC magnetic field generated thereby, and the lever (40) is activated the moment the magnetic field is offset to activate the circuit breaker in response to operation of a device connected to the mechanism.

The circuit breaker thus described is such that the energy of the permanent magnet (10) is very small, because the magnetic field of the permanent magnet (10) is offset by using a current of several milliampere flowing in the secondary winding of the ZCT in case a leakage occurs. Generally, the force by the conventional permanent magnet (i.e., the energy) is obtained by multiplication by coercivity (Hc) and residual magnetic flux density (Br), which is BH characteristic.

In case products are mass-manufactured corresponding to respectively different sensitivity currents, for example, in case the sensitivity currents are 30 mA, 100 mA and 300 mA, an energy intensity of a permanent magnet with a sensitivity current of 300 mA is generally greater than that of a permanent magnet with a sensitivity current of 30 mA.

A demagnetization method is representatively used for setting up an energy intensity of a permanent magnet. The demagnetization method is a method in which an AC current-flowing electronic magnet is made to approach a vicinity of an assembled RCCB (Residual-Current Circuit Breaker) to demagnetize the intensity of the permanent magnet assembled inside the RCCB.

However, the demagnetization method thus described is disadvantageously problematic in that a desired sensitivity current value can be obtained only through several repeated performances of demagnetization, because an accurate demagnetization is not obtainable by a one-time process, and a remagnetization process must be added for over-magnetized products caused by erroneous operation of an operator, thereby complicating the work and lengthening the work time.

SUMMARY

The present disclosure has been made to solve the foregoing problems of the prior art and therefore an object of certain embodiments of the present invention is to provide a circuit breaker configured to minimize a defect ratio of a product, to simplify work processes and to remarkably reduce working hours by changing a magnetic path (magnetization) direction of a permanent magnet assembled on a yoke of a trip coil to perform a sensitivity set-up of the permanent magnet.

In one general aspect of the present disclosure, there is provided a circuit breaker, comprising: a yoke forming a magnetic path of magnetic field; a trip coil mounted at a bottom surface of the yoke and directly connected to a secondary winding of a ZCT (Zero-phase Current Transformer); a lever arranged at one side of the yoke to trip a mechanism of the circuit breaker; a spring connected to the lever to provide an elasticity to the lever; and a permanent magnet rotatably hinged to the other side of the yoke, wherein the permanent magnet is changed in magnetic path direction by the rotation to set up a sensitivity current.

The circuit breaker according to the present disclosure is advantageous in that defect ratio of product is minimized by allowing a yoke to include a rotatably-hinged permanent magnet, and changing a magnetic path direction by rotation of the permanent magnet to set up a sensitivity current.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 9 is a table showing an intensity change of a force of a lever based on a magnetization direction of a permanent magnet according to an exemplary embodiment of the present disclosure.

DETAILED DESCRIPTION

Figure 1:
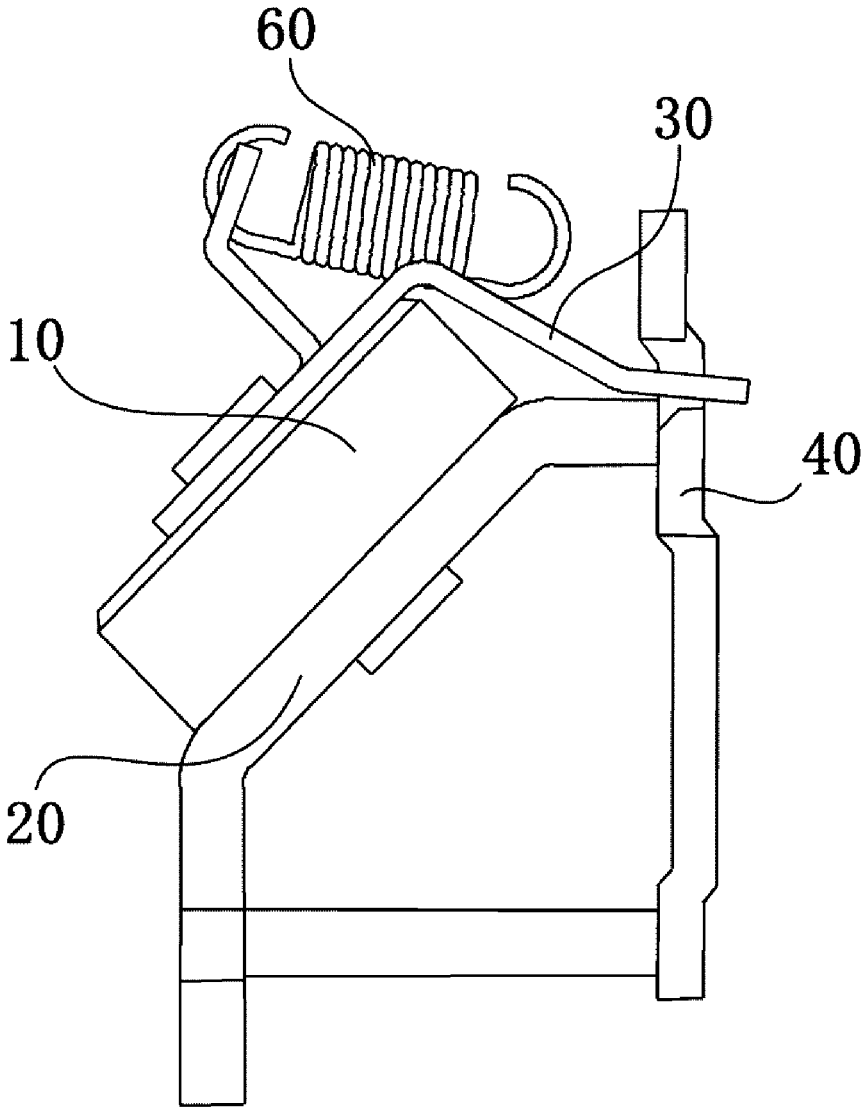
FIG. 1 (PRIOR ART)
FIG. 1 is a lateral view illustrating a trip coil assembly of a circuit breaker according to prior art.
Figure 2:
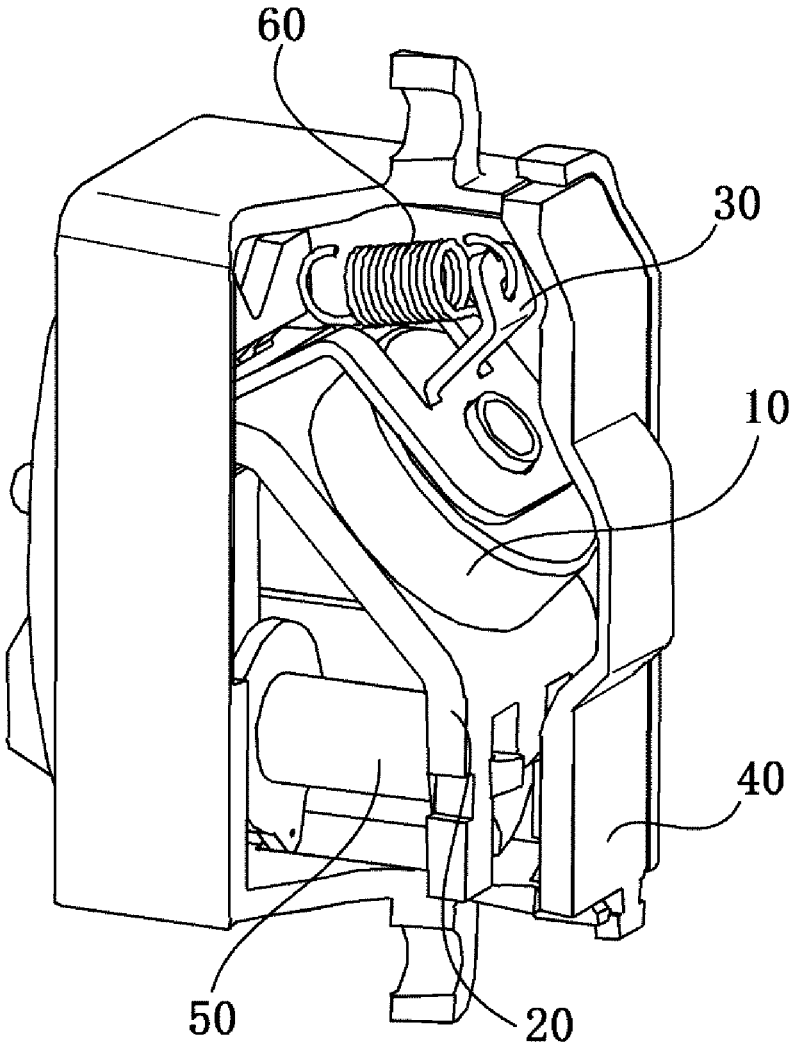
FIG. 2 (PRIOR ART)
FIG. 2 is a perspective view illustrating a trip coil assembly of a circuit breaker according to prior art.

The disclosed embodiments and advantages thereof are best understood by referring to FIGS. 1-9 of the drawings, like numerals being used for like and corresponding parts of the various drawings. Other features and advantages of the disclosed embodiments will be or will become apparent to one of ordinary skill in the art upon examination of the following figures and detailed description. It is intended that all such additional features and advantages be included within the scope of the disclosed embodiments, and protected by the accompanying drawings. Further, the illustrated figures are only exemplary and not intended to assert or imply any limitation with regard to the environment, architecture, or process in which different embodiments may be implemented. Accordingly, the described aspect is intended to embrace all such alterations, modifications, and variations that fall within the scope and novel idea of the present invention.

Meanwhile, the terminology used herein is for the purpose of describing particular implementations only and is not intended to be limiting of the present disclosure. The terms "first," "second," and the like, herein do not denote any order, quantity, or importance, but rather are used to distinguish one element from another. For example, a second constituent element may be denoted as a first constituent element without departing from the scope and spirit of the present disclosure, and similarly, a first constituent element may be denoted as a second constituent element.

As used herein, the terms "a" and "an" herein do not denote a limitation of quantity, but rather denote the presence of at least one of the referenced item. That is, as used herein, the singular forms "a", "an" and "the" are intended to include the plural forms as well, unless the context clearly indicates otherwise.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Also, "exemplary" is merely meant to mean an example, rather than the best. If is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated.

That is, in the drawings, the size and relative sizes of layers, regions and/or other elements may be exaggerated or reduced for clarity. Like numbers refer to like elements throughout and explanations that duplicate one another will be omitted.

Now, a circuit breaker according to an exemplary embodiment of the present disclosure will be described in detail with reference to the accompanying drawings.

Figure 3:
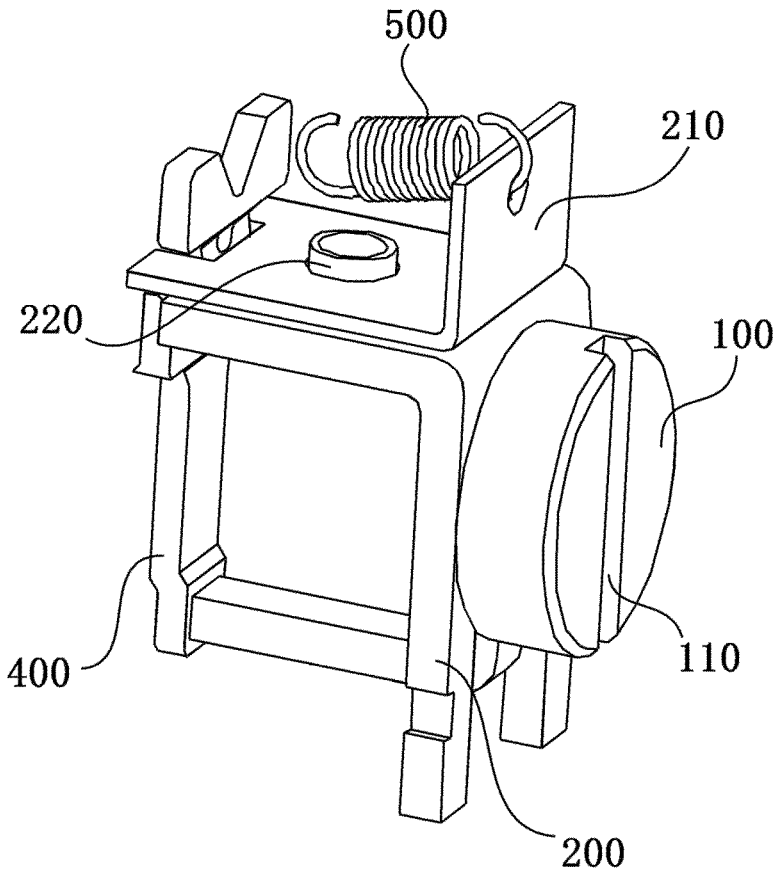
FIG. 3 is a perspective view illustrating an interior of a trip coil assembly in a circuit breaker according to an exemplary embodiment of the present disclosure.
Figure 4:
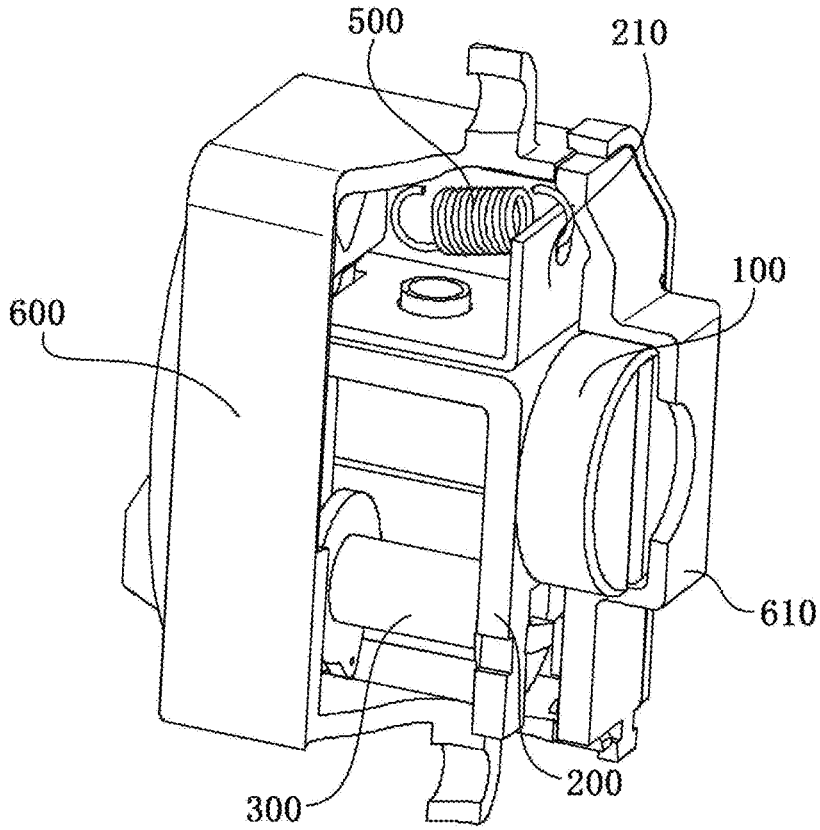
FIG. 4 is a partially cutaway perspective view of a trip coil assembly in a circuit breaker according to an exemplary embodiment of the present disclosure.
Figure 5:
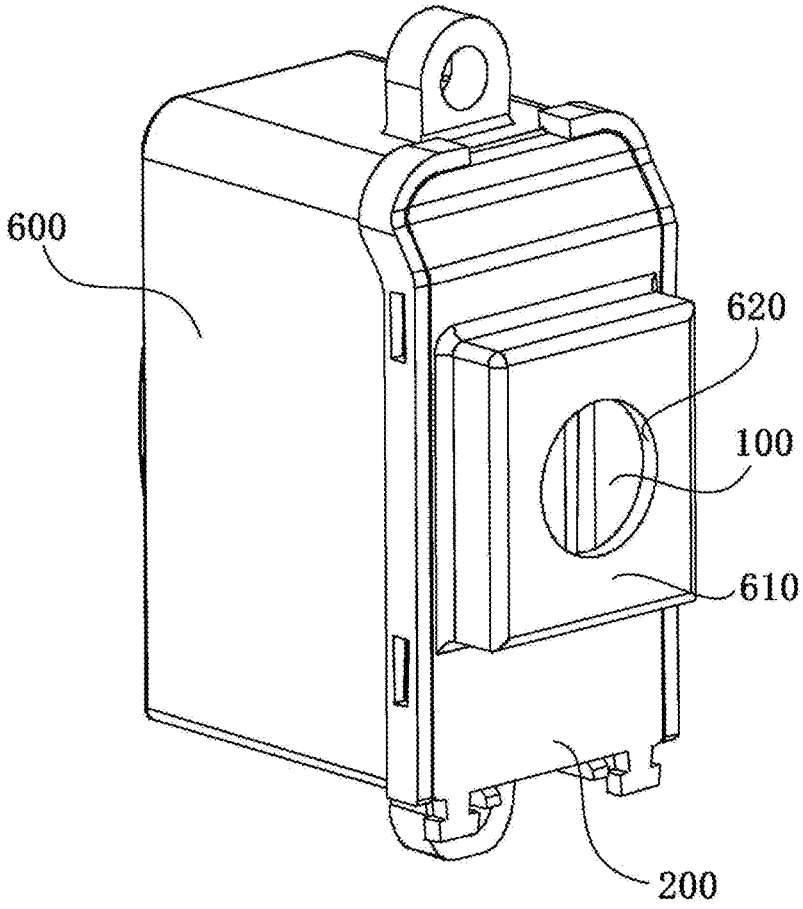
FIG. 5 is a perspective view illustrating a trip coil assembly in a circuit breaker according to an exemplary embodiment of the present disclosure.

FIG. 3 is a perspective view illustrating an interior of a trip coil assembly in a circuit breaker according to an exemplary embodiment of the present disclosure, FIG. 4 is a partially cutaway perspective view of a trip coil assembly in a circuit breaker according to an exemplary embodiment of the present disclosure, and FIG. 5 is a perspective view illustrating a trip coil assembly in a circuit breaker according to an exemplary embodiment of the present disclosure.

A circuit breaker according to an exemplary embodiment of the present disclosure includes a permanent magnet (100), a yoke (200) rotatably hinged to the permanent magnet (100) to form a magnetic path of magnetic field formed by the permanent magnet, a trip coil (300) mounted at the yoke (200) to be directly connected to a secondary winding of a ZCT (Zero-phase Current Transformer), a lever (400) arranged at one side of the yoke (200) to trip a mechanism of the circuit breaker, and a spring (500) connected to the lever (400) to provide an elasticity to the lever (400).

The permanent magnet (100) takes a round shape having a predetermined thickness, one lateral surface of one side of the permanent magnet (100) being rotatably hinged to the yoke (200) and one lateral surface of the other side of the permanent magnet (100) having a tool insertion groove (110) for rotating the permanent magnet (100) using a separate tool to change a magnetization direction (magnetic path direction) of the permanent magnet (100).

In one non-limiting example, the tool insertion groove (110) takes a straight shape, and may be used with a flat-head screwdriver for changing the magnetization direction. However, the tool is not limited to the flat-head screwdriver, and any type of screwdriver may be used.

The yoke (200) is secured at an upper surface thereof with a bracket (210) using a rivet (220), rotataly mounted at a lateral surface thereof with the permanent magnet (100), mounted at a bottom surface with the trip coil (300) and arranged at an opposite side of the lateral surface arranged with the permanent magnet (100) with the lever (400). The bracket (210) is secured at one side to a distal end of the spring (500), and rotatably supported at the other side by the lever (400).

Furthermore, the lever (400) is rotatably supported by the bracket (210), and trips the circuit breaker by being rotated by elasticity of the spring (500), in a case a current flows to the trip coil (300) to offset the magnetic field formed by the permanent magnet (100).

An external side of the yoke (200) is mounted with a molded case (600) for preventing foreign objects such as dust from entering the yoke (200), and a lateral surface formed with the permanent magnet (100) is arranged with a cover (610) secured to the case (600) to wrap the permanent magnet.

The cover (610) is provided with a tool path (620) through which a tool passes whereby the tool can be inserted into the insertion groove (110) of the permanent magnet (100).

The circuit breaker according to the exemplary embodiment of the present disclosure is advantageous in that working hours setting up a sensitivity current of the permanent magnet (100) can be drastically reduced, and product defect caused by over-demagnetization or insufficient de-magnetization can be prevented by rotating the permanent magnet (100) to change magnetization direction (magnetic path direction) of the permanent magnet (100) and to set up a sensitivity current.

Next, a setting method of sensitivity current in response to rotation of a permanent magnet will be described.

Figure 6:
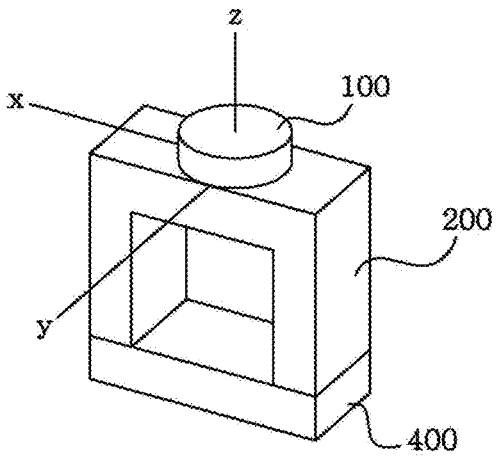
FIG. 6 is a schematic view illustrating a simplified permanent magnet, a simplified yoke and a simplified lever according to an exemplary embodiment of the present disclosure.
Figure 7:
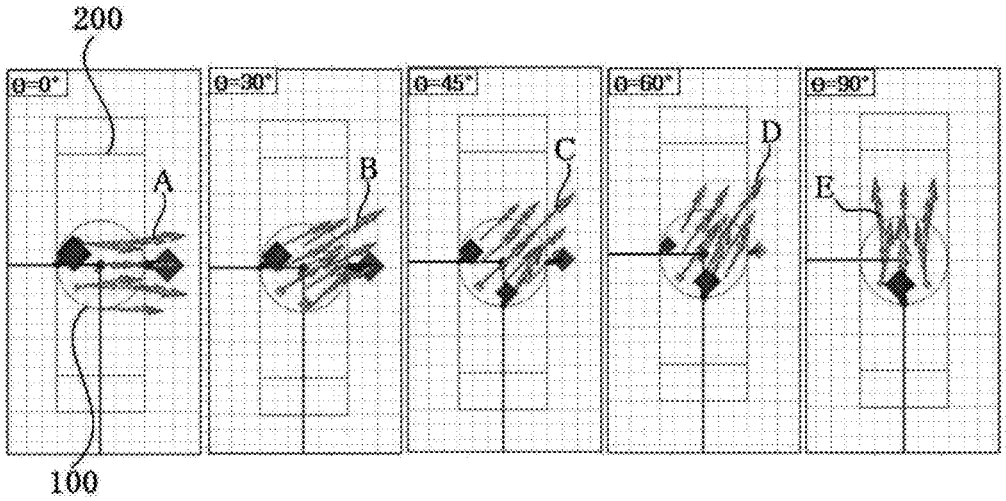
FIG. 7 is a graph illustrating a change of magnetic field advancing direction based on magnetization direction of a permanent magnet according to an exemplary embodiment of the present disclosure.

FIG. 6 is a schematic view illustrating a simplified permanent magnet, a simplified yoke and a simplified lever according to an exemplary embodiment of the present disclosure, and FIG. 7 is a graph illustrating a change of magnetic field advancing direction based on magnetization direction of a permanent magnet according to an exemplary embodiment of the present disclosure.

Referring to FIG. 6, in a case a magnetization direction of the permanent magnet is an X axis while position of the permanent magnet (100) is set up by an X axis, a Y axis, and a Z axis, θ is 90°, and θ is 0° in a case the magnetization direction of the permanent magnet is Y axis. The magnetic path direction of the permanent magnet varies depending on position of the permanent magnet.

That is, in a case θ is 0°, the magnetic path direction of the permanent magnet is distributed as shown in A to be horizontal with Y axis, and in a case a tool is inserted into the tool insertion groove (110) of the permanent magnet (100) to rotate the permanent magnet (100) to a predetermined degree to make θ 30°, the magnetic path direction of the permanent magnet (100) is distributed as shown in B to form an angle with Y axis at 30°.

In a case the permanent magnet (100) is rotated to make θ 45°, the magnetic path direction of the permanent magnet (100) is distributed as shown in C to form an angle with Y axis at 45°. In a case the permanent magnet (100) is rotated to make θ 60°, the magnetic path direction of the permanent magnet (100) is distributed as shown in D to form an angle with Y axis at 60°. In a case the permanent magnet (100) is rotated to make θ 90°, the magnetic path direction of the permanent magnet (100) is distributed as shown in E to form an angle with Y axis at 90°.

As noted above, the magnetic path directions are changed depending on rotational angle of the permanent magnet, and intensity of the permanent magnet applied to the lever (400) is changed, as the magnetic path direction of the permanent magnet is changed.

Figure 8:
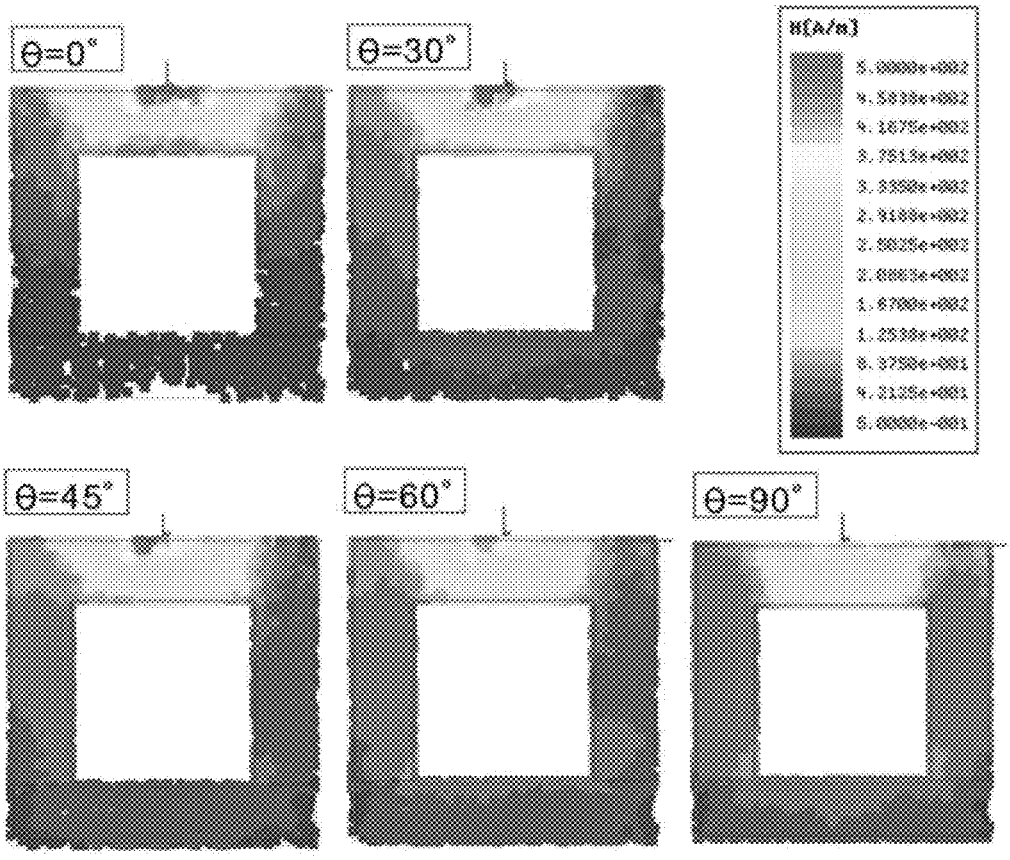
FIG. 8 is a schematic view illustrating a yoke based on a magnetization direction of a permanent magnet and an intensity distribution of a magnetic field flowing in a lever according to an exemplary embodiment of the present disclosure.

That is, as shown in FIG. 8, if the intensity of force of the permanent magnet applied to the lever is measured in response to change in θ value, it can be noticed that magnetic field flowing in the yoke (200) and the lever (400) is least distributed in a case θ is 0°, distribution of magnetic field flowing in the yoke (200) and the lever (400) gradually increases as θ the value increases, and distribution of magnetic field flowing in the yoke (200) and the lever (400) becomes maximum when θ is 90°.

Furthermore, as illustrated in FIG. 9, it can be noted that the intensity of force acting on the lever gradually increases as the θ value increases when the intensity of force acting on the lever is measured in response to the change of the θ value.

As apparent from the foregoing, the circuit breaker according to the present disclosure has an industrial applicability in that a defect ratio of a product can be minimized and work processes can be simplified because of enablement of sensitivity current set-up in a permanent magnet by rotating the permanent magnet to change the magnetic path (magnetization) direction of a permanent magnet.

Although the present disclosure has been described with reference to a number of illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A circuit breaker, comprising:

a yoke configured to form a magnetic field path;

a trip coil mounted to the yoke and directly connected to a secondary winding of a ZCT (Zero-phase Current Transformer);

a lever arranged at a first side of the yoke and configured to trip a mechanism of the circuit breaker;

a spring a first end of which is connected to the lever and configured to provide a resistive force to the movement of the lever;

a permanent magnet rotatably coupled to a second side of the yoke opposite the first side and configured to rotate in order to change a magnetic path direction of the permanent magnet to adjust a sensitivity current of the circuit breaker;

a bracket mounted to the yoke opposite the trip coil wherein a first side of the bracket supports the lever; and wherein the permanent magnet is rotatably coupled to a lateral surface of the second side of the yoke and positioned such that an axis of rotation of the permanent magnet is substantially perpendicular to a longitudinal length of the lever when the lever is in a closed position.

2. The circuit breaker of claim 1, wherein a second end of the spring is secured to a second side of the bracket that is opposite the first side of the bracket.

3. The circuit breaker of claim 1, wherein the permanent magnet has a tool insertion groove in a predetermined shape.

4. The circuit breaker of claim 1, further comprising a cover substantially enclosing the permanent magnet.

5. The circuit breaker of claim 4, wherein the cover comprises a tool insertion path.

* * * * *